US005388494A

United States Patent [19]

Hoshino

[11] Patent Number: 5,388,494

[45] Date of Patent: Feb. 14, 1995

[54] ADJUSTMENT MECHANISM FOR DRUM PEDAL BEATER

[75] Inventor: Yoshiki Hoshino, Aichi, Japan

[73] Assignee: Hoshino Gakki Co., Ltd., Nagoya, Japan

[21] Appl. No.: 138,131

[22] Filed: Oct. 15, 1993

[30] Foreign Application Priority Data

Mar. 19, 1993 [JP] Japan ..... 5-018600[U]

[51] Int. Cl.[6] ..... G10D 13/02

[52] U.S. Cl. ..... 84/422.1

[58] Field of Search ..... 84/422.1, 422.2, 422.3

[56] References Cited

U.S. PATENT DOCUMENTS 3,797,356 3/1974 Duffy et al. ..... 84/422.1
4,691,613 9/1987 Jacobson ..... 84/422.1
4,756,224 7/1988 Lombardi ..... 84/422.1

FOREIGN PATENT DOCUMENTS 4-124295 4/1991 Japan .

*Primary Examiner*—Michael L. Gellner
*Assistant Examiner*—Cassandra Spyrou
*Attorney, Agent, or Firm*—Ostrolenk, Faber, Gerb & Soffen

[57] ABSTRACT

A drum beater includes a support with the beater rotary shaft on the support. A swingable beater attached to the beater rotary shaft is adjustable in position around that shaft for establishing the swing distance between the beater and the drum head. An operating member on the shaft is connected to the drum pedal such that operation of the drum pedal rotates the shaft. A beater shaft restoring cam is attached to a spring which is increasingly tensioned as the drum pedal is operated and which returns the cam and the beater shaft to a return position when the pedal is released. The cam is adjustably positionable in orientation around the beater rotary shaft.

4 Claims, 14 Drawing Sheets

ADJUSTMENT MECHANISM FOR DRUM PEDAL BEATER

BACKGROUND OF THE INVENTION

This invention relates to an adjustment mechanism for a beater of a drum pedal enabling free adjustment of the beater amplitude and the pedal height.

In a conventional beater mechanism for a bass drum, shown for example in FIGS. 13 and 14, supports 92 are erected at both sides of the base 91 of a drum pedal device 90. A beater rotary shaft 94 is freely rotatably supported at the tops of the supports 92 through respective ball bearings 93.

There is a beater 110 approximately at the center of the rotary shaft 94, and next to the beater is an operating member 120, which is in the shape of a wheel. Both rotate integrally with the beater 110. The beater head 115 is fixed to the beater 110 by means of stopping screws 116.

The operating member 120 comprises a sprocket or a partial sprocket, with a chain 121 having an end that is fixed at the operating member 120 and is wound on its outer periphery. The other end of the chain 121 is linked to the tip of a foot pedal 95. As the foot pedal 95 is stepped on, as indicated by an arrow mark A in FIG. 13, the chain 121 is pulled down. This rotates the operating member 120 which in turn rotates the beater, thereby causing the beater head 115 to beat the drum head surface D.

A cam 100 is fixed at the end of the rotary shaft 94 by a stopper screw 101, as shown in FIG. 15. The cam 100 has the approximate shape of a fan, as shown in FIG. 13. At that portion which corresponds to the pivot of the fan, there is a shaft receiving hole 102 through which the rotary shaft 94 is installed. A plurality of roller installation holes 103 are provided at various positions over the cam.

A roller installation bolt 104 is screwed into one of the roller installation holes 103 selected dependent upon the initial pivot orientation of the cam 100. A hanging ring 106 is suspended from a roller 105 that is inserted into the roller installing bolt 104. The top of the spring 107 is engaged at the bottom tip of the hanging ring 106. The bottom of the spring 107 is engaged with a lower bracket 109 at the outside of the support 92. The strength of the spring 107 returns the beater 115 to its original position automatically. An adjustment bolt 108 adjusts the tension of the spring 107. A clamp 130 holds the drum pedal 90 to the drum hoop.

Amplitude adjustment of the conventional beater 115 involves changing the incline of the beater 110 through the beater rotary shaft 94, thereby changing the distance between the beater head 115 and the drum surface D, by changing the incline of the cam member 100 through selecting the positions of the plurality of roller installation holes 103 on the cam member 100. With such a conventional mechanism, however, it has been difficult to effect a fine adjustment based on the performer's wishes and the form of the performance because the amplitude position of the beater is determined, step-like, by the positions of the roller installation hole 103. Also, to adjust the beater amplitude position, the roller installation bolt 104 has to be removed and the spring 107 had to be changed each time, thereby consuming time for the adjustment.

In view of the foregoing circumstances, the inventor herein earlier proposed in Japanese Utility Model No. Hei 4-124295 a beater amplitude adjustment mechanism for the drum pedal using an arc shaped roller installation groove in the cam member with the beater rotary shaft at its center and with the roller being fixed in the installation groove so as to be freely adjustable in the drum pedal and where a cam is fixed at the end of a beater rotary shaft that is freely rotatably supported on a support and the spring is adjusted through a roller in the cam. This enables expressions of delicate sound quality because the amplitude of the beater can be adjusted without any steps merely by changing the rotary position of the beater rotary shaft as compared with the spring in the cam.

In either of the above described structures, where the beater and the operating member are fixed to the beater rotary shaft, however, a change in the rotary position of the beater rotary shaft in an attempt to adjust the amplitude of the beater would change the height position of the foot pedal through the simultaneous rotation of the operating member, thereby inconveniencing the performer.

SUMMARY OF THE INVENTION

An object of the invention is to adjust the amplitude or arc of swing of the beater of a drum pedal without any steps.

Another object is to provide a beater adjustment mechanism for the drum pedal which is also capable of adjusting the height of the foot pedal.

The beater adjustment mechanism for a drum pedal of the invention includes a rotary shaft on which a beater is installed and is rotated by an operating member that is linked to a pedal. The adjustment mechanism is supported on a support. A cam is provided at one end of the beater rotary shaft. A spring is provided between the cam and the lower part of the support. The beater rotary shaft is installed freely rotatably, as compared with the cam, and the beater member is also installed freely rotatably as compared with the beater rotary shaft.

Other objects and features of the invention are explained below with reference to the attached drawings:

DETAILED DESCRIPTION OF THE PREFERRED EMBODIMENTS

Figure 1:
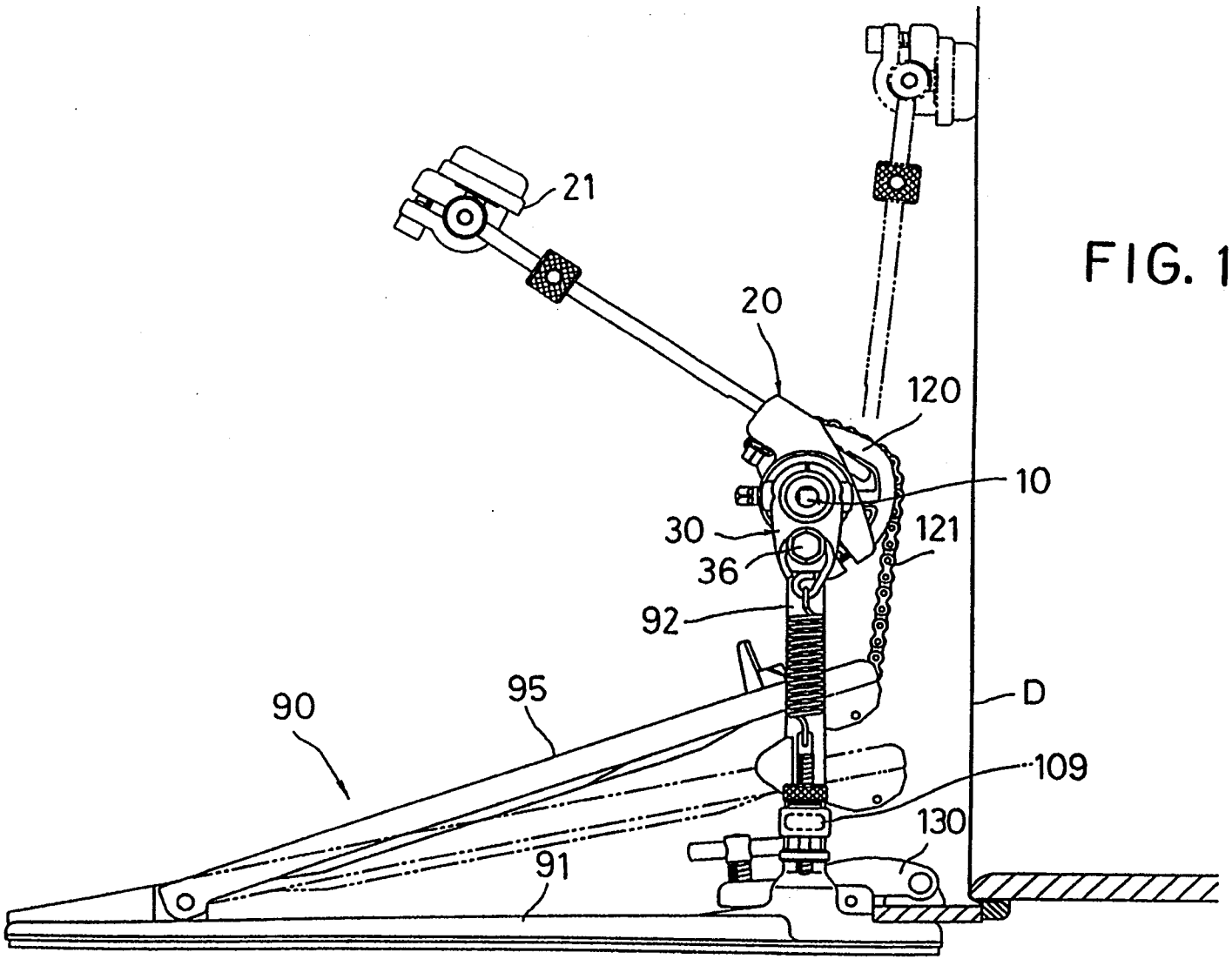
FIG. 1 is a side view of a drum pedal equipped with a beater adjustment structure according to the invention.
Figure 2:
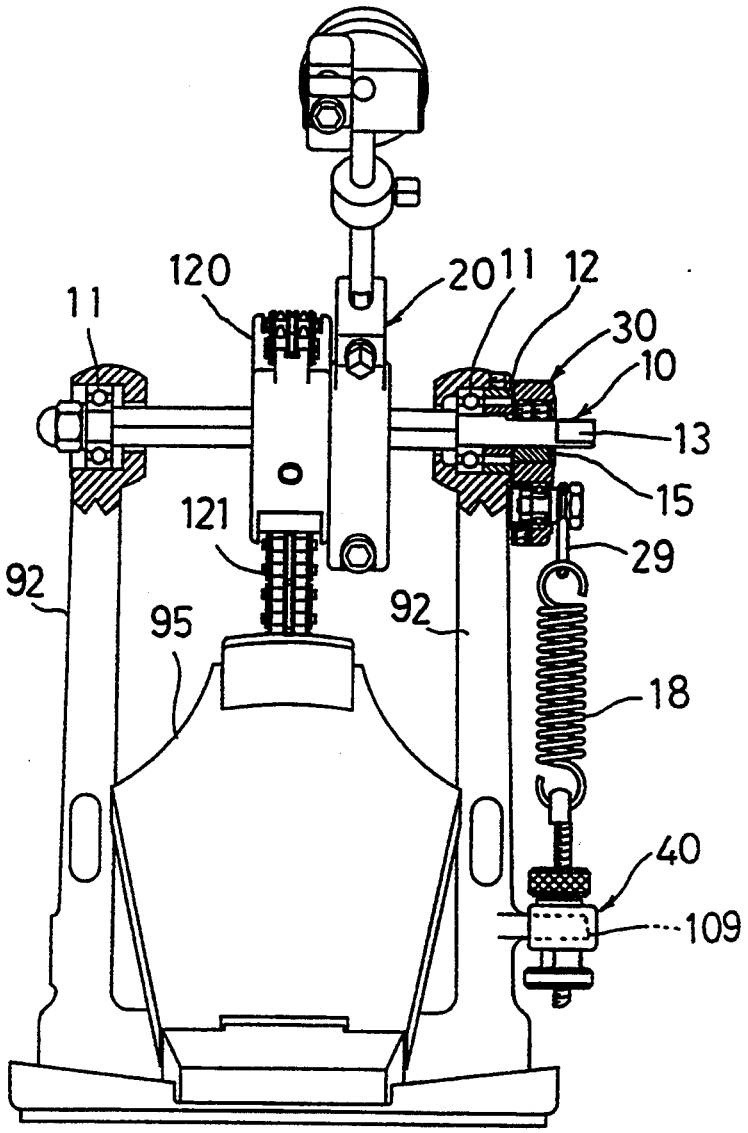
FIG. 2 is a rear view of a part of the drum pedal, partly in cross section.
Figure 13:
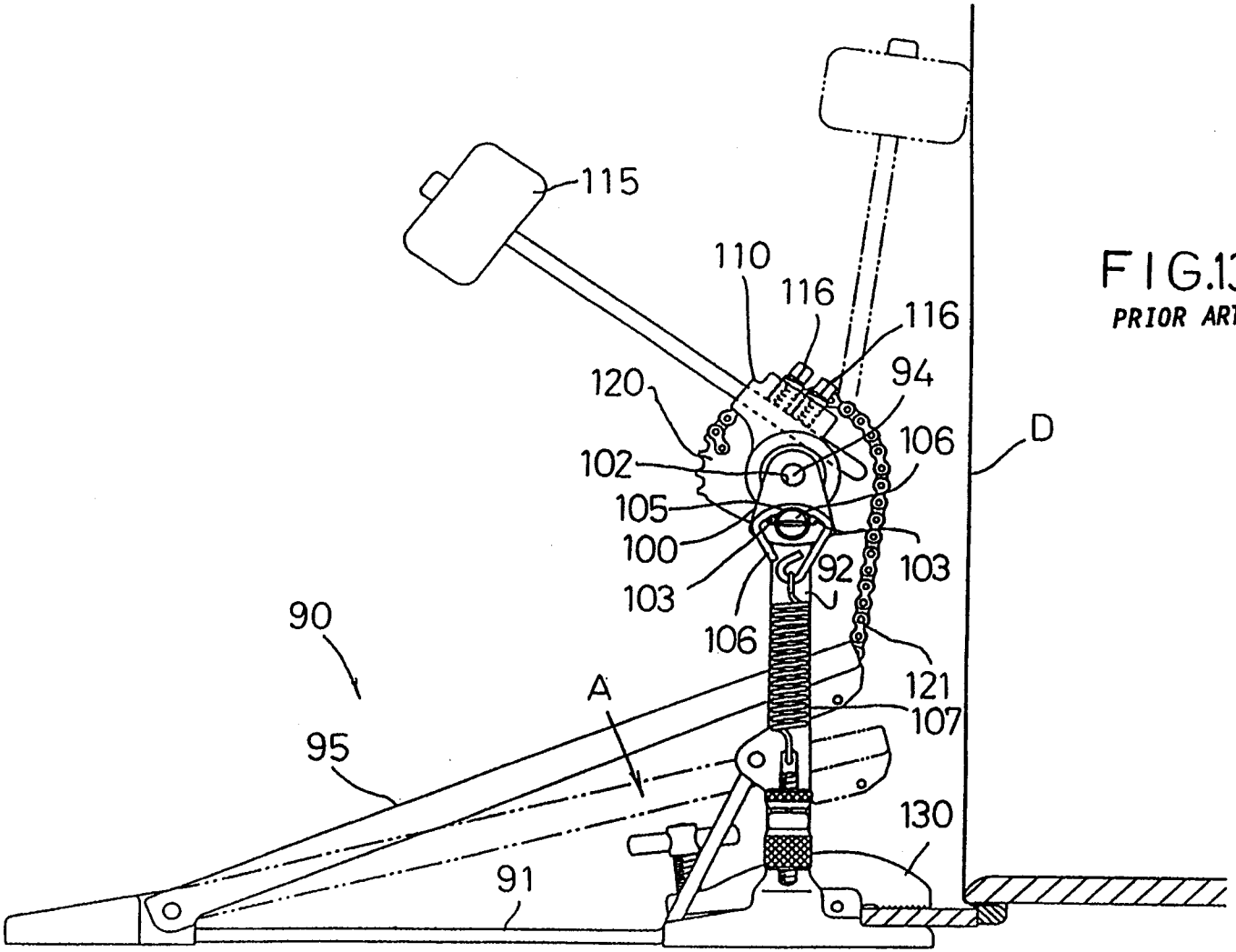
FIG.13 PRIOR ART
FIG. 13 is a side view of a beater adjustment mechanism for a drum beater according to the prior art.
Figure 14:
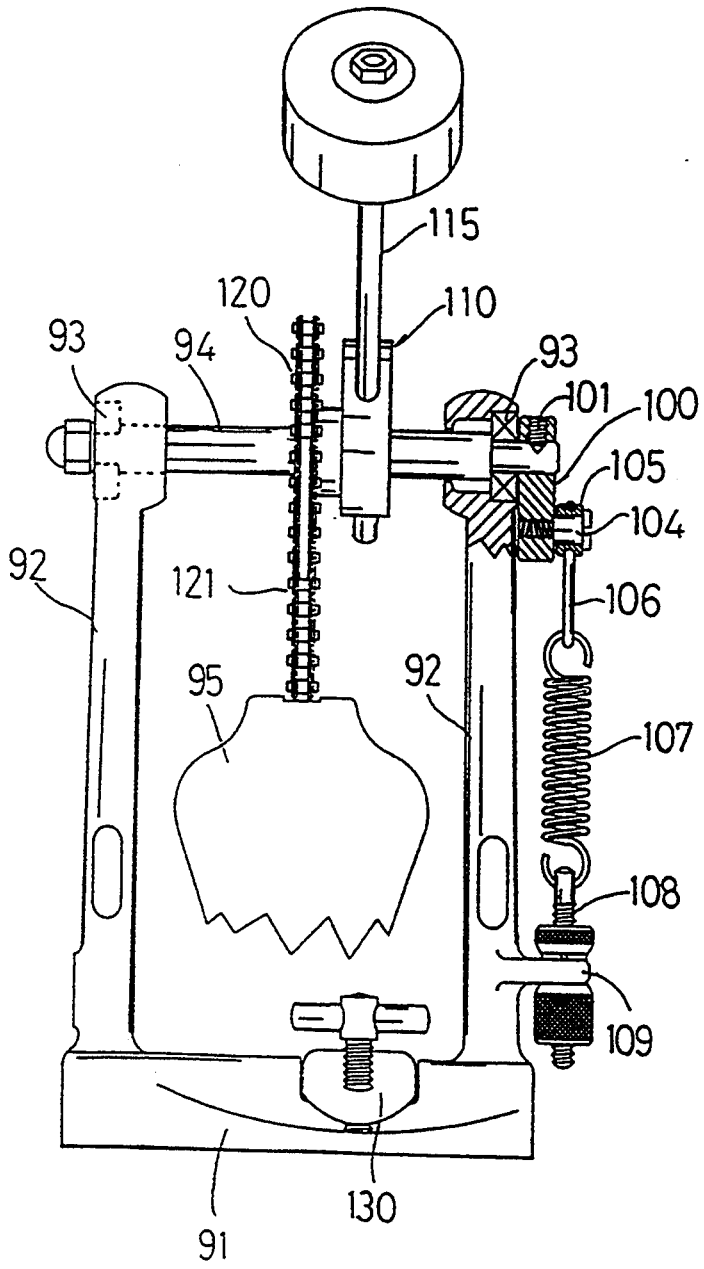
FIG.14 PRIOR ART
FIG. 14 is a rear view thereof with a part shown in cross section.
Figure 15:
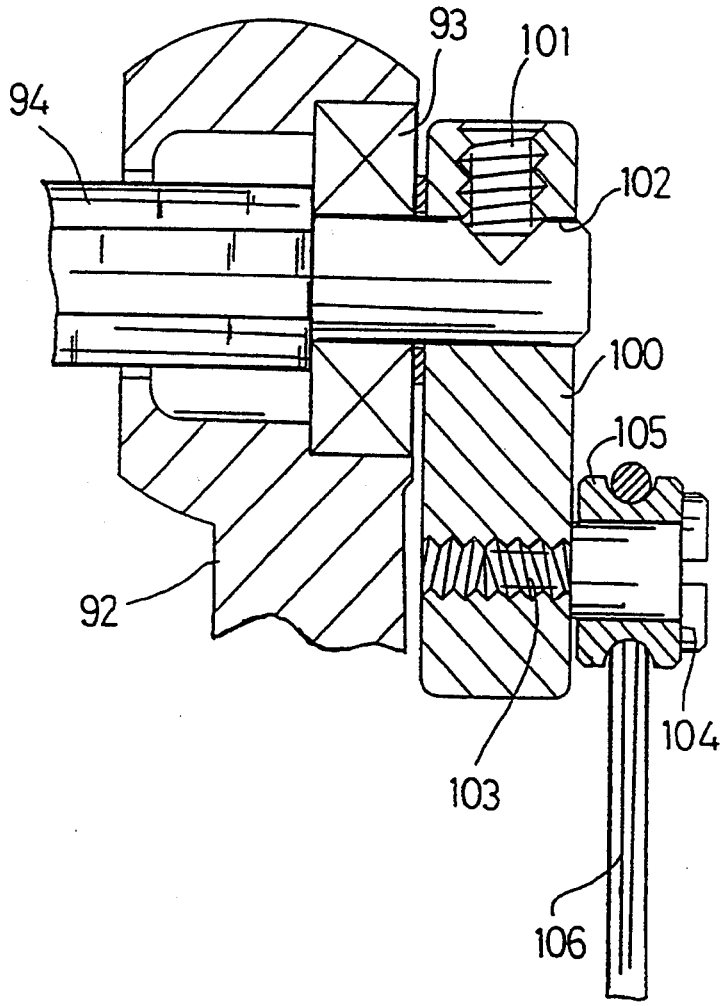
FIG.15 PRIOR ART
FIG. 15 is a cross section showing its essential part.

The beater adjustment device for a drum pedal in FIGS. 1 and 2 includes a beater rotary shaft 10 and a beater member 20 like those provided in a conventional drum pedal device 90 shown in FIG. 13.

The beater rotary shaft 10 is rotatably freely supported by a bearing 11 on both sides of the base 91 of the drum pedal device 90. The bearing is held at 12.

Figure 3:
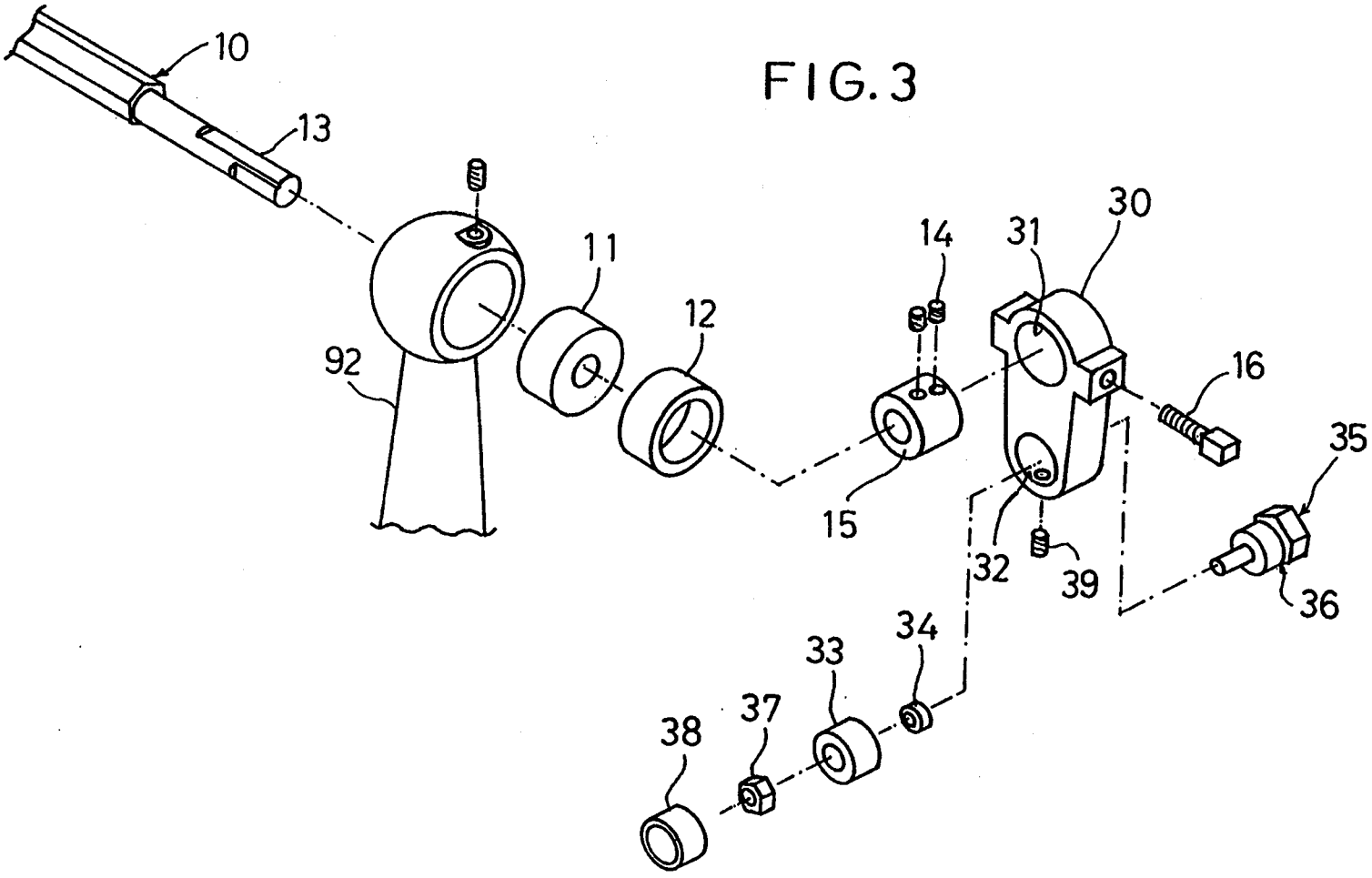
FIG. 3 is a dismantled oblique view of the essential part showing the rotary adjustment structure of the beater rotary shaft and the cam.
Figure 4:
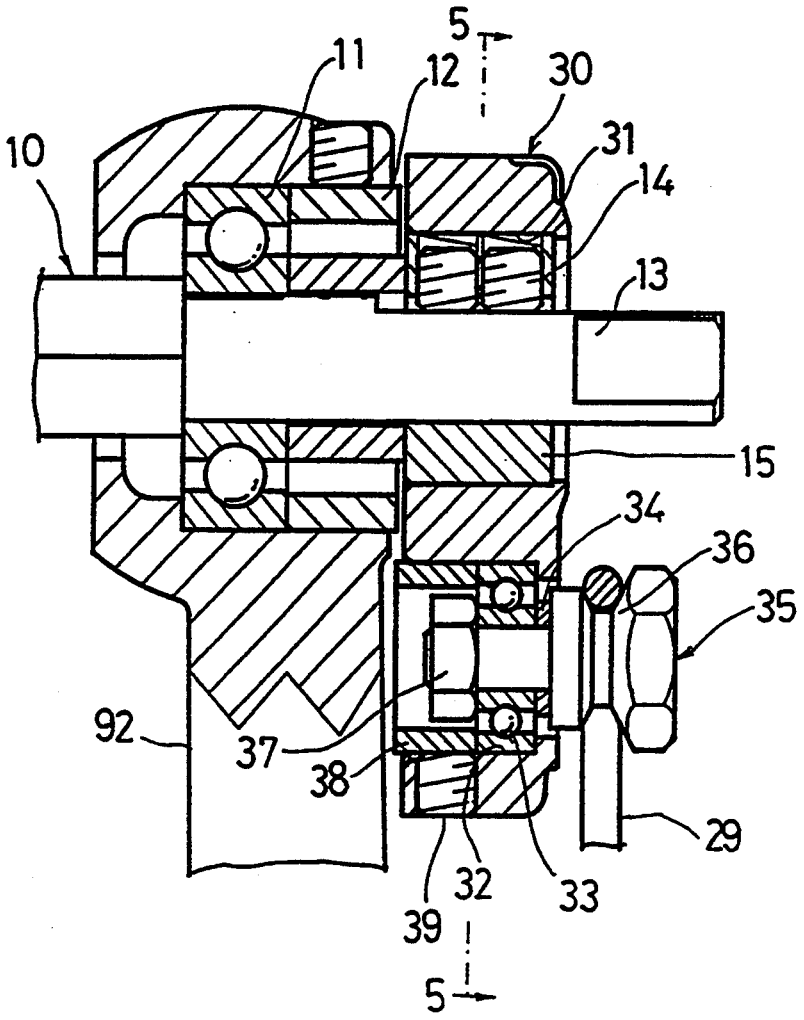
FIG. 4 is a cross section thereof.
Figure 5:
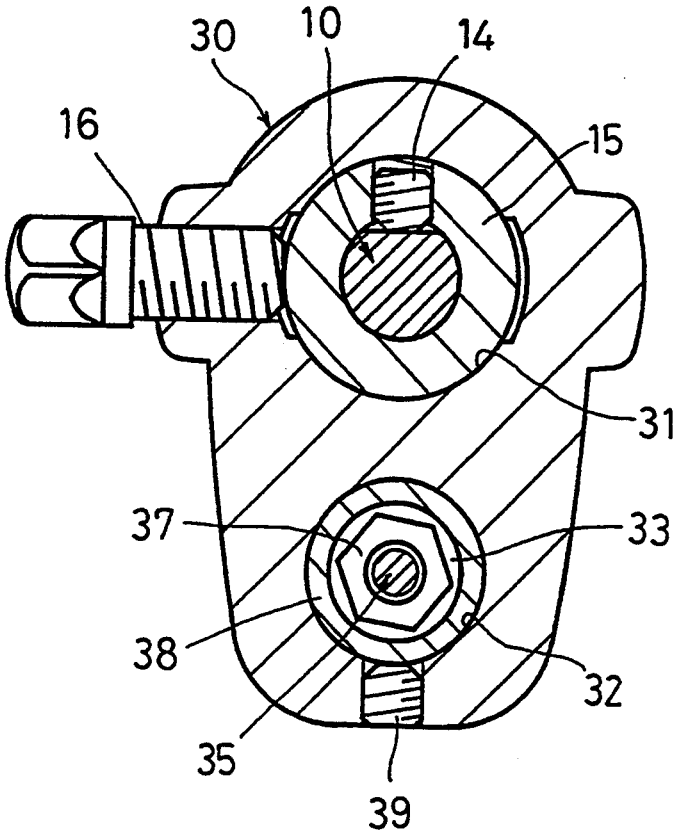
FIG. 5 is a cross section along line 5—5 in FIG. 4.

At the end of the beater rotary shaft 10, a cam 30 is supported by a cam receiver 15. The cam 30 includes a bearing hole 31, through which the beater rotary shaft 10 is inserted, and a roller installation hole 32, as shown in FIGS. 3 through 5. The cam 30 is freely rotatably installed with reference to the roller rotary shaft 10 and slides along the outer surface of the cam receiver 15.

A fixing screw 14 fixes the cam receiver 15 to the beater rotary shaft 10. A stopping screw 16 fixes the position of the cam 30 with reference to the beater rotary shaft 10.

There is a bearing 33 at the roller installation hole 32 of the cam 30. A roller 35 is inserted into the bearing freely rotatably. A hanging part 36 is provided at the tip of the roller 35, and one end of a spring 18 is installed on the hanging part 36 through a hanging ring 29. A metal washer 34 positions the bearing 33 on the roller 35. There is a tightening nut 37 for the roller 35. There are bearing tightening screws 38 and tightening screw 39. The bearing 33 enables the spring 18 to be easily rotated without obstruction of rotation of the roller 35 even when the tension of the spring 18 may be added to the hanging part 36.

Figure 6:
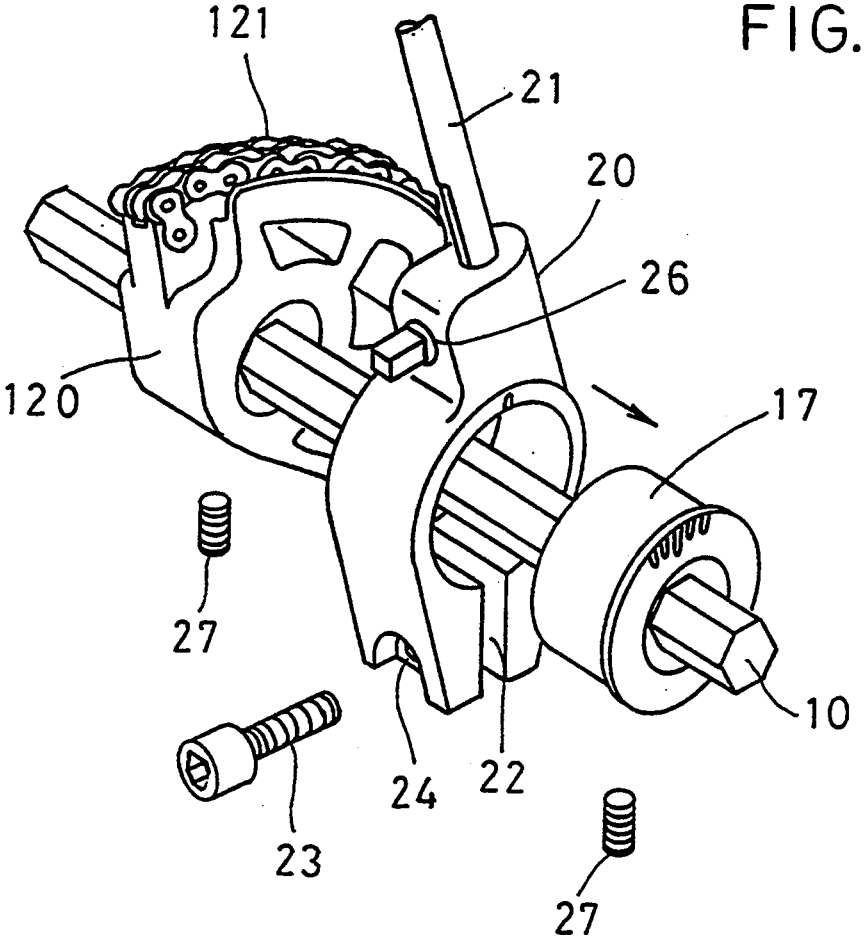
FIG. 6 is an oblique dismantled view of the essential part showing the rotary adjustment mechanism of the beater member and the beater rotary shaft.

As seen in FIG. 6, a tightening part 17 with a diameter somewhat larger than that of the beater rotary shaft 10 is formed around the shaft 10. The tightening part 17 is fixed to the beater rotary shaft 10 by a fixing bolt 27 and it rotates along with the shaft 10. The tightening part 17 may be formed integrally with the operating member 120.

Figure 7:
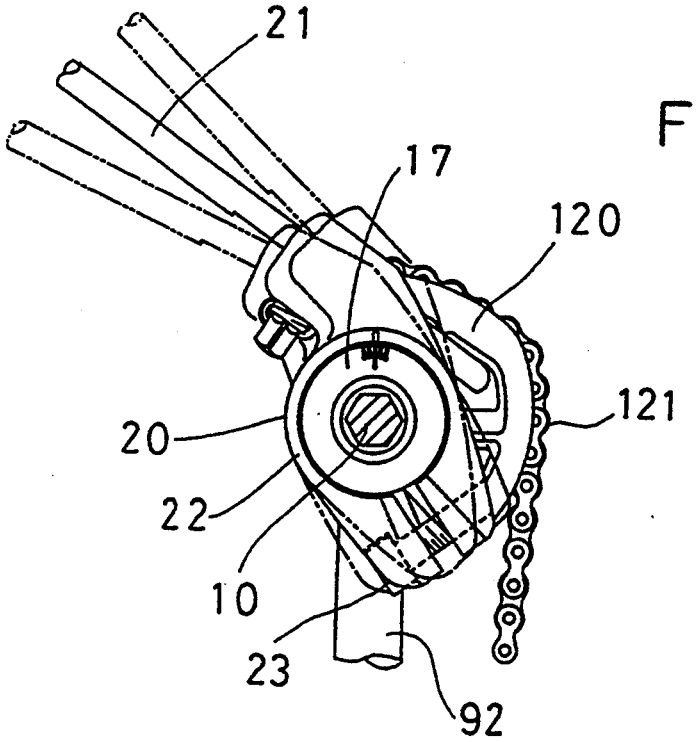
FIG. 7 is a cross section showing the state of its adjustment.

Beater member 20 has a generally tubular shape and is split at one side at a cut groove 22. It supports a beater 21. The beater member 20 is freely rotatably installed onto the tightening part 17 and is fixed there through tightening of the sides of the beater member at the cut groove 22 with a tightening bolt 23. As shown in FIG. 7, therefore the beater member 20 is freely rotatably installed on the beater rotary shaft 10 enabling changing of the amplitude distance of the beater 21 from the drum head irrespective of the position of the beater rotary shaft 10.

Figure 8:
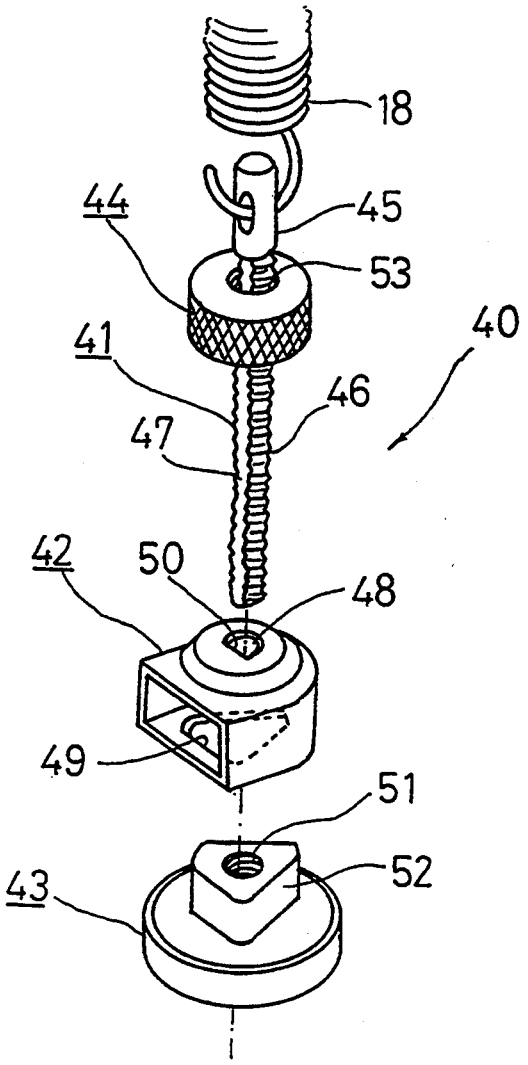
FIG. 8 is an oblique dismantled view of essential parts of a spring adjustment device.
Figure 9:
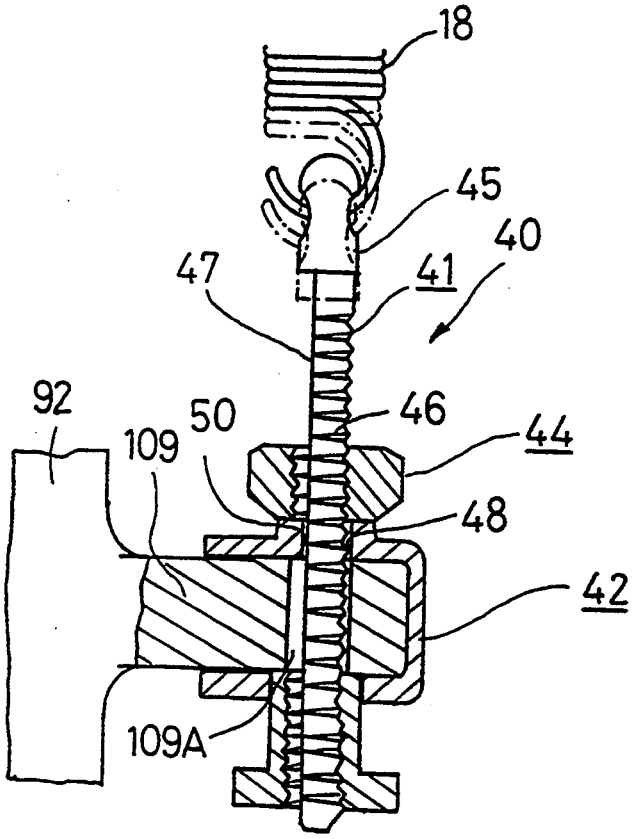
FIG. 9 is a cross section thereof.

The spring 18 is installed on the hanging part 36 of the roller 35. As shown in FIGS. 8 and 9, the other end of the spring 18 is connected to the lower bracket 109 provided on the lower side of the support 92 through an adjustment device 40. The spring 18 acts on the cam to restore the beater rotary shaft and the beater to an inoperative position when the pedal is stepped on to rotate the beater, as described below.

The adjustment device 40 comprises an adjustment screw 41, a rotation stopper holding member 42, an adjustment nut 43 and a lock nut 44.

The adjustment screw 41 is a bar of a suitable length, with a thread 46 formed on its surface. It includes an engaging part 45 that engages the spring 18. The adjustment nut 43 is screwed on from the other end through the lock nut 44 and rotary stopper holding member 42. The adjustment screw 41 has a flat part 47 without the thread 46 along its longitudinal direction.

The rotary stopper holding member 42 prevents the adjusting screw 41 from being rotated at the time of an adjustment. This avoids a change in the orientation of the spring 18 that has been installed through the engaging part 45 and avoids a change in the resistance and the load on the spring 18. The rotary stopper holding member 42 includes an insertion hole 48 at the top through which the adjustment screw 41 is inserted and includes a cut out bottom window 49 which engages the protrusion 52 of the adjustment nut 43 at the bottom.

The holding member 42 is installed on the lower bracket 109. In FIG. 9, a through hole 109A for the adjustment screw 41 is provided through the lower bracket 109.

An engagement part 50 is provided in the insertion hole 48. It engages the plane part 47 of the adjustment screw 41. This prevents rotation of the adjustment screw 41 that has been inserted into the insertion hole 48.

The adjustment nut 43 is screwed on from the bottom of the adjustment screw 41. There is a protrusion 52 around the screw hole 51 of the adjustment nut 43 that engages in the cut out window 49 of the rotary stopper holding member 42. The engagement of the protrusion 52 with the window 49 attempts to halt any loosening of the adjustment nut 43 and prevents change in the tension of the spring 18.

On the upper side of the rotary stopper holding member 42, there is a lock nut 44 on the adjustment screw 41. The lock nut 44 fixes the screw length, as compared with the rotary stopper holding member 42 of the adjustment screw 41, by screwing it against the rotary stopper holding member 42. The nut has a screw hole 53 through which the adjustment screw 41 is inserted.

The adjustment device 40 loosens the lock nut 44 and lifts it in the direction of the spring 18. At the same time, the device pulls down the adjustment nut 43 along with the adjustment screw 41, which disengages the protuberant part 52 of the nut 43 from the cut out window 49 of the rotary stopper holding member 42. This permits adjustment nut 43 to be freely rotatable.

Rotating the adjustment nut 43 changes the length of the adjustment screw 41 that is formed between the lower end of the spring and the lower bracket 109 and this adjustment is carried out until a suitable spring tension is obtained.

When the tension of the spring 18 has been adjusted, the protrusion 52 of the adjustment nut 43 is again engaged with the cut out window 49 of the rotary stopper holding member 42, fixing the adjustment nut 43 again so that it may not rotate. The lock nut 44 is screwed onto the adjusting screw 41 at the rotary stopper holding member 42, thereby holding its position. This holds the adjusting screw 41 at a location which gives the least resistance to the spring 18 and remains almost un-rotated. This prevents the adjustment nut 43 from being loosened and prevents the adjustment screw 41 from shaking. As it does not provide any effect upon the tension of the spring 18, further, it is capable of restoring the beater with a certain tension at all times.

Figure 10:
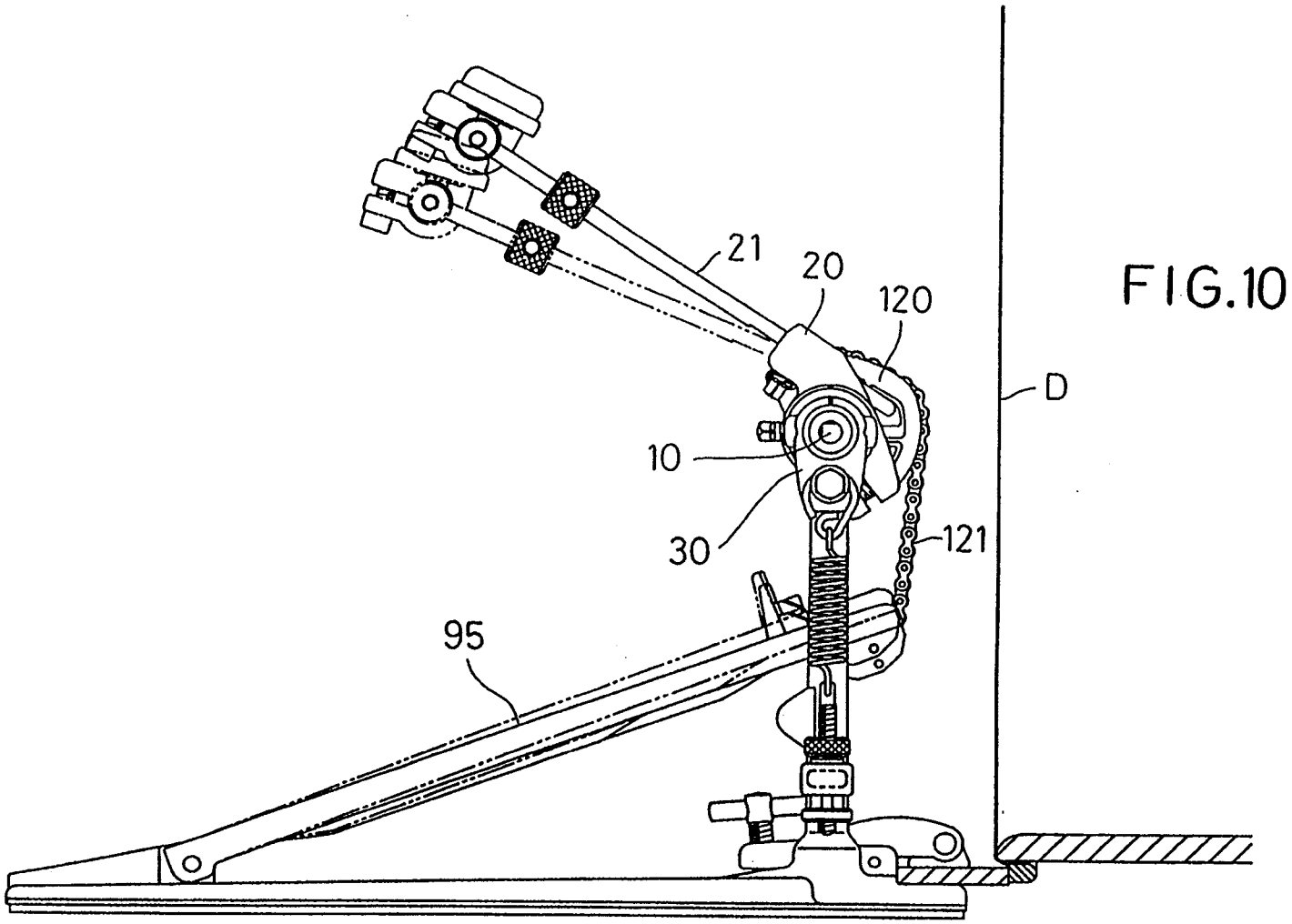
FIG. 10 is a side view showing an example of the action of the mechanism of the invention.
Figure 11:
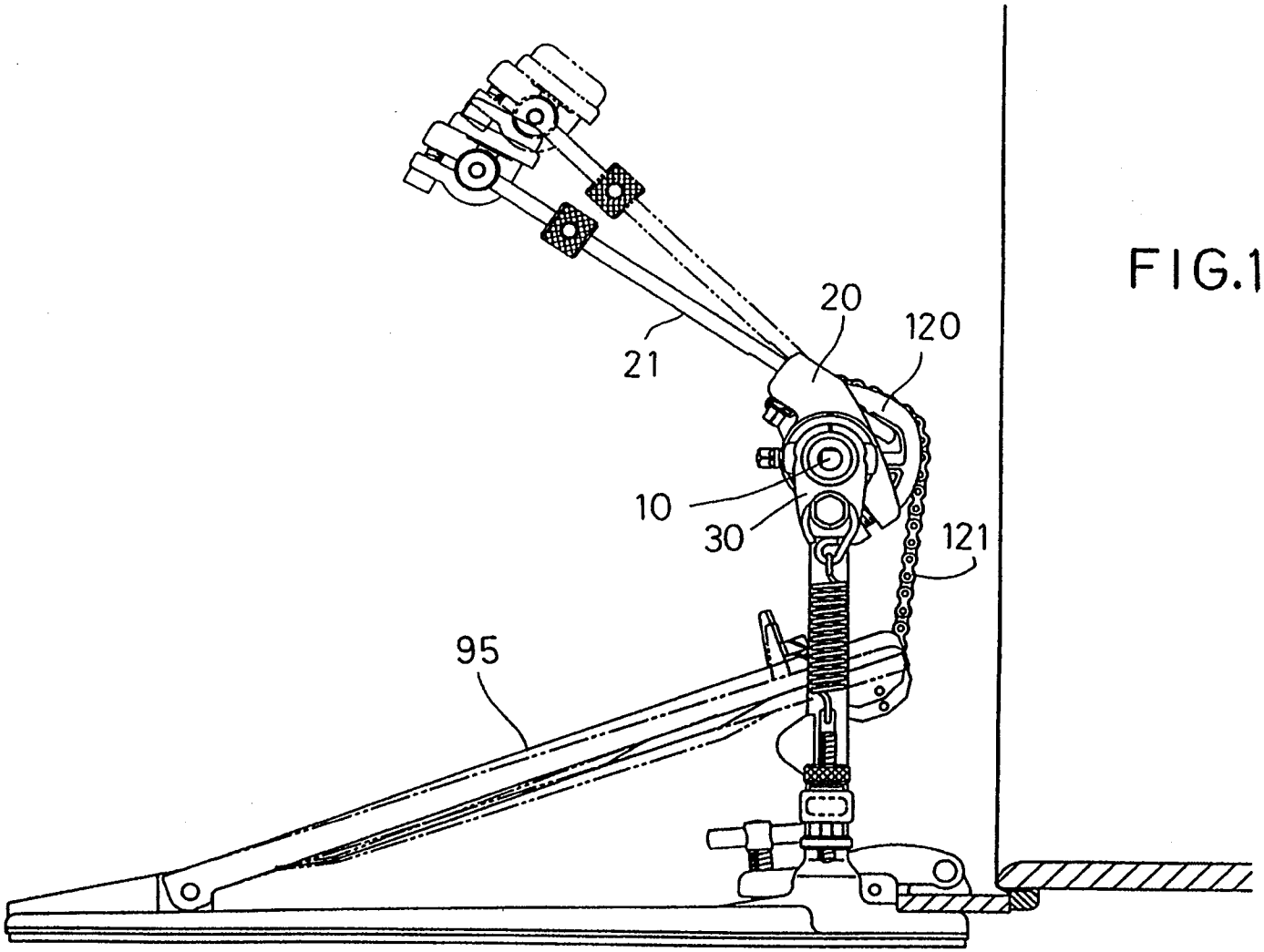
FIG. 11 is a side view of an example of its action.

As shown in FIGS. 10 and 11, rotation of the beater rotary shaft 10 for changing the initial height position of the foot pedal 95 also rotates the operating member 120 integrally. By winding or rewinding the chain 121 that is linked to the foot pedal 95 and by fixing the cam 30 to the beater rotary shaft 10 at a desired location, the height position of the foot pedal 95 can be changed.

As the beater rotary shaft 10 is installed freely rotatably with respect to the cam member 30 through the cam receiver 15, it is possible to change the position of the foot pedal 95 without steps and the positioning can respond to any delicate requirement of the pedal height.

Figure 12:
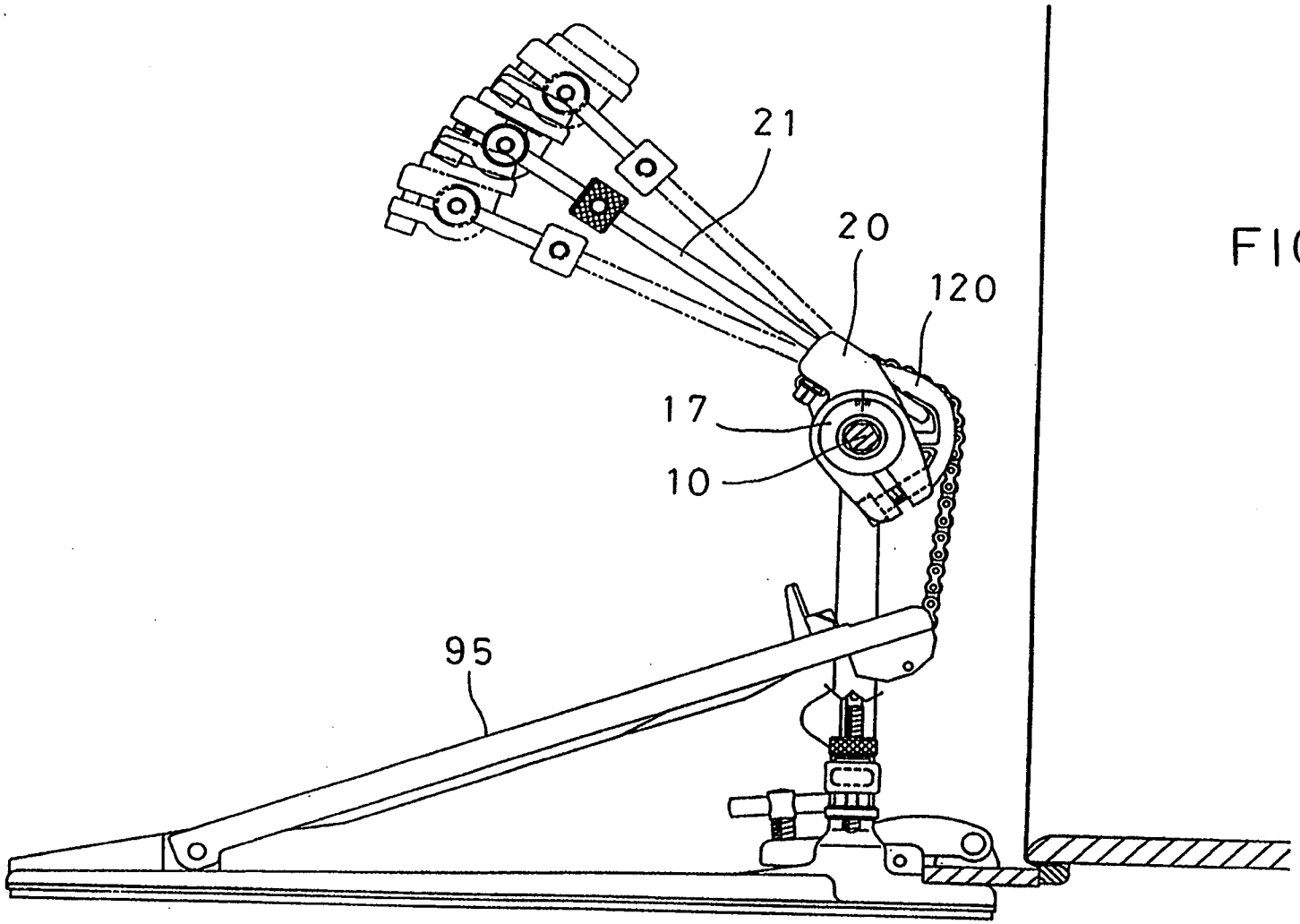
FIG. 12 is a cross section showing the state of adjustment between the beater rotary shaft and beater member.

As shown in the cross section in FIG. 12, the beater member 20 can be rotated on the tightening part 17 formed on the beater rotary shaft 10 without changing the rotary position of the rotary shaft 10 or the position of the operating member 120. This makes it possible to fix the beater 21 at a desired amplitude distance away from the drum head, while maintaining the height position of the foot pedal 95.

The beater adjustment mechanism for a drum pedal of this invention enables the beater rotary shaft to be freely rotatably installed, as compared with the cam, to adjust the amplitude distance of the beater swing path without steps and without changing the angle of the cam. Since the beater member is installed freely rotatably, as compared with the beater rotary shaft, it is possible to adjust the amplitude distance of the beater without steps and without changing the pedal height.

The amplitude distance of the beater and the height position of the pedal can be adjusted independently of each other. Accordingly, the drum beater is capable of any delicate adjustments to satisfy the wishes of the individual performer and conform to the form of the performance.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. An adjustment mechanism for a drum pedal comprising:

a support; a beater rotary shaft supported on the support and rotatable around the axis of the shaft;

a drum beater and a beater member having a generally tubular shape for supporting the drum beater, the beater member being rotatably connected to the shaft, the drum beater including a beater head for being swung toward and away from a drum head as the beater member rotates with the shaft; the beater member selectively enabling free rotation of the beater around the shaft and including means to enable independent adjustment of the beater relative to the rotary shaft to any selected rotative orientation of the beater with respect to the shaft, the means to enable independent adjustment of the beater including a cut groove extending through one side of the beater member such that the beater member is split at the one side, a tightening bolt at the cut groove for selectively loosening and tightening the beater member on the beater rotary shaft to enable independent adjustment of the beater relative to the rotary shaft;

a beater rotary shaft operating member on the beater rotary shaft, such that rotation of the operating member rotates the shaft for swinging the beater head; a swing pedal on the support to be operated by a performer, connecting means connecting between the pedal and the operating member so said operation of the pedal moves the operating member to rotate the shaft;

a cam supported on the shaft for free rotation with respect to the shaft to different orientations with reference to the shaft; means for fixing the cam at any selected rotative orientation with respect to the beater rotary shaft to enable independent adjustment of the cam relative to the beater rotary shaft; and a spring connected between the cam and the support so that the spring operates the cam to rotate the shaft to a stable position;

whereby the pedal and the beater may be independently set to respective initial positions by the adjustment of the corresponding rotative orientations of the beater and of the cam around the beater rotary shaft.

2. The drum beater of claim 1, wherein the pedal is supported on the support for being swung up and down as the pedal is operated, and the connecting means between the pedal and the operating member comprises a chain extending from the pedal and wrapped around the operating member such that stepping on the pedal draws on the chain to partially unwrap the chain from the operating member to rotate the operating member to rotate the shaft; the cam and the spring therefor being so placed that rotation of the operating member through operation of the pedal increases the tension on the spring, so that the spring urges the cam to turn the beater rotary shaft to swing the beater away from the drum and to restore the pedal to an inoperative position.

3. The drum beater of claim 2, further comprising means for adjusting the tension on the spring for adjusting the tension on the pedal.

4. The drum beater of claim 1, wherein the cam is supported on the beater rotary shaft through a cam receiver, the cam sliding along an outer surface of the cam receiver for free rotation with respect to the shaft, a fixing screw fixing the cam receiver to the shaft, and the means for fixing the cam comprises a stopping screw for fixing the cam to the cam receiver at any selected rotative orientation with respect to the shaft.

* * * * *